US009943132B1

(12) United States Patent
Tsai

(10) Patent No.: US 9,943,132 B1
(45) Date of Patent: Apr. 17, 2018

(54) SUPPORT INSOLE FOR SHOES

(71) Applicant: FUSCO INDUSTRIAL CORPORATION, Taipei (TW)

(72) Inventor: Chen-Yu Tsai, Taipei (TW)

(73) Assignee: Fusco Industrial Corporation, Taipei (TW)

( * ) Notice: Subject to any disclaimer, the term of this patent is extended or adjusted under 35 U.S.C. 154(b) by 40 days.

(21) Appl. No.: 15/295,661

(22) Filed: Oct. 17, 2016

(51) Int. Cl.
*A43B 7/14* (2006.01)
*A43B 17/00* (2006.01)
*A43B 17/14* (2006.01)

(52) U.S. Cl.
CPC ..... *A43B 7/141* (2013.01); *A43B 7/142* (2013.01); *A43B 7/143* (2013.01); *A43B 7/144* (2013.01); *A43B 7/149* (2013.01); *A43B 7/1425* (2013.01); *A43B 7/1435* (2013.01); *A43B 7/1445* (2013.01); *A43B 17/006* (2013.01); *A43B 17/14* (2013.01)

(58) Field of Classification Search
CPC ..... A43B 7/142; A43B 7/143; A43B 7/144; A43B 7/149; A43B 7/1425; A43B 7/1435; A43B 7/1445
USPC ..... 36/141
See application file for complete search history.

(56) References Cited

U.S. PATENT DOCUMENTS 4,897,937 A * 2/1990 Misevich ..... A43B 7/1425 36/140
5,005,575 A * 4/1991 Geri ..... A43B 7/14 36/43
5,685,094 A * 11/1997 Lin ..... A43B 1/0054 36/141
6,510,626 B1 * 1/2003 Greenawalt ..... A43B 7/142 36/160
8,615,905 B1 * 12/2013 Szabo ..... A43B 1/0081 36/11.5
2001/0039746 A1 * 11/2001 Seiter ..... A43B 7/142 36/44
2007/0033834 A1 * 2/2007 Cheskin ..... A43B 7/141 36/44
2011/0179672 A1 * 7/2011 Cheng ..... A43B 7/141 36/71
2014/0259755 A1 * 9/2014 Tsai ..... A43B 7/1415 36/43
2015/0000158 A1 * 1/2015 Wang ..... A43B 7/142 36/43

* cited by examiner

*Primary Examiner* — Ted Kavanaugh
(74) *Attorney, Agent, or Firm* — Wang Law Firm, Inc.

(57) ABSTRACT

An support insole includes a middle medium sandwiched between flexible upper and lower layers, wherein upper layer has a forefoot region with a metatarse protrusion that projects upward from an upper surface of the upper layer to a certain height, a midfoot region with inner and outer arch sides, wherein the inner arch side has an inner arch protrusion that projects upwardly from the upper surface to a certain height and wherein the outer arch side has a plurality of outer arch protrusions that project upwardly from the upper surface to a certain height, a hindfoot region with a heel support protrusion that projects upwardly from the upper surface to a certain height, wherein the top face is dented inwardly so as to form a concave recess such that the support insole is ergonomically designed to provide comfort for a wearer.

7 Claims, 5 Drawing Sheets

SUPPORT INSOLE FOR SHOES

BACKGROUND OF THE INVENTION

1. Field of the Invention

The present invention relates generally to an insole, and more particularly to a support insole for shoes which is ergonomically designed in such a manner to provide extra comfort to reduce fatigue of foot, thereby enabling a person to maintain a normal walking condition.

2. The Prior Arts

When we are walking, we are putting 0.8-1.2 times of our body weight on a single foot in addition to the counterforce from the ground. The counterforce of the ground usually causes problems in our ankles, knees, skeleton or other body parts and in the long time, may result in injury to our foot, especially knees and ankles. To avoid this, it is best to put a support insole in our shoes to absorb the stress or shock.

A conventional support insole is fabricated from leathers and simply provides support to our feet. In other words, the conventional support insole is weak in shock absorption. Another support insole fabricated from elastic materials is a choice to remedy the defects of the conventional support insole and is suitable to for every pair of shoes, since the elastic materials can absorb the shock caused during walking, thereby protecting the foot from being injured. Hence, the support insole fabricated from elastic materials is much preferred due to its thickness for putting into the shoes and comfort provided thereby. A water-absorption breathable fabric is generally provided on the elastic support insole.

Owing to damping characteristics of the elastic support insole and due to each person requires energy during walking, the muscles of the foot still may get fatigue. In addition, it is noted that the elastic support insole is too soft and is weak in resistance against the impact of the ground.

Moreover, a foot generally has an arch portion that defines a gap with a supporting surface such that during walking (when the foot touches the ground) a gap is formed between the arch portion of one person's foot and the support insole. The conventional support insole fails to provide cushioning effect to the arch portion of the foot, hence causing fatigue to the walking foot.

Another drawback of the conventional support insole resides in that the hindfoot portion is generally flat and therefore fails to provide cushioning effect the heel of the foot, thereby causing discomfort the wearing person.

SUMMARY OF THE INVENTION

A primary objective of the present invention is to provide a support insole that is ergonomically constructed, that has a better impact resistance and that provides comfortable feeling during walking. In addition, the support insole provides a cushioning effect to the arch portion of the foot during touching of the ground so as to reduce fatigue of foot mentioned in the prior arts.

Another objective of the present invention resides in that the flexible upper and lower layers fabricated from different materials are securely and fixedly bond together in such a manner to dispose the upper layer to contact with the sole of the foot and the lower layer is disposed to contact with an interior of the shoes while a middle medium is used for securely binding the upper and lower layers in order to avoid the undesired separation of the upper and lower layers at the peripheries confining the layers In one aspect of the present invention resides in that a middle medium is sandwiched between the flexible upper and lower layers fabricated from different materials are securely and fixedly bond relative to one another in such a manner that the upper layer includes a forefoot region, a midfoot region and a hindfoot region, wherein the forefoot region has a metatarse protrusion that projects upward from an upper surface of the upper layer, the midfoot region has opposite inner and outer arch sides, wherein the inner arch side has an inner arch protrusion that projects upwardly from the upper surface of the upper layer to a certain height and wherein the outer arch side has a plurality of outer arch protrusions that project upwardly from the upper surface of the upper layer to a certain height, and the hindfoot region has a heel support protrusion that projects upwardly from the upper surface of the upper layer to a certain height and that has a top face, wherein the top face is dented inwardly so as to form a concave recess. When the support insole is to dispose inside of a shoe, the same provides effective cushioning support to the arch portion and the heel portion of the wearer's foot due to ergonomic structure.

Accordingly, a support insole of the present invention includes a flexible upper layer, a middle medium and a flexible lower layer. The flexible upper layer is configured as an inner bottom side of a shoe, includes a forefoot region, a midfoot region and a hindfoot region, wherein the forefoot region has a metatarse protrusion that projects upward from an upper surface of the upper layer, the midfoot region has opposite inner and outer arch sides, wherein the inner arch side has an inner arch protrusion that projects upwardly from the upper surface of the upper layer to a certain height and that has the greatest elevation of 4.2 mm-4.8 mm with respect to the upper surface of the upper layer, wherein the outer arch side has a plurality of outer arch protrusions that project upwardly from the upper surface of the upper layer to a certain height and that has the greatest elevation of 4.2 mm-4.8 mm with respect to the upper surface of the upper layer, the hindfoot region having a heel support protrusion that projects upwardly from the upper surface of the upper layer to a certain height and that has a top face with the greatest elevation of 3 mm-4 mm with respect to the upper surface of the upper layer, wherein the top face is dented inwardly so as to form a concave recess with a depth of 2.2 mm-2.7 mm. The middle medium is attached to a bottom surface of the upper layer. The flexible lower layer has an upper surface attached to a bottom surface of the middle medium. Due to the reasons that the upper and lower layers are fabricated from different flexible materials and that the support insole is ergonomically constructed, the support insole provides a better cushioning support to the foot.

According to an embodiment of the present invention, each of the outer arch protrusions is hemispherical shape. The outer arch protrusions extend from a front part to a rear part of the upper layer, and includes a first outer arch protrusion, a second outer arch protrusion and a third outer arch protrusion, wherein the first outer arch protrusion has a diameter greater than that of the second outer arch protrusion while the second outer arch protrusion has a diameter greater than that of the third outer arch protrusion. Owing to the present of the inner and outer arch protrusions, the inner and outer arch portions of a wearer's foot can achieve an effective support in addition to the massaging effects.

It is to note that when a person is standing, the majority of the body weight is generally concentrated and distributed at the middle portion and the outer arch portion of the foot.

Therefore, in the support insole of the present invention, the inner arch protrusion of the inner arch side has a volume greater than a combined total volume of the first outer arch protrusion, the second outer arch protrusion 1 and the third outer arch protrusion such that the inner arch portion of the standing foot is supported by a greater volume, thereby provide a balance cushioning support to the entire portion of the sole of the wearer.

Note again that during walking, it is the front portion of the foot that stresses against the ground. Therefore, in the support insole of the present invention, the metatarse protrusion of the forefoot region has a volume greater than the volume of the inner arch protrusion of the inner arch side such that the forefoot of the foot is supported in a greater area and volume, thereby providing a fine balance of the entire foot.

Also note that while a person is walking, it is the heel portion of the foot that touches the ground successively after the fore portion. Therefore, in the support insole of the present invention, the heel support protrusion of the hindfoot region has a volume greater than the volume of the inner arch protrusion of the inner arch side.

To be more specific, the flexible upper layer is fabricated from foam materials including EVA (Ethylene-vinyl acetate), Latex, PU (Polyurethane) while the flexible lower layer is fabricated from materials including TPRs (Thermoplastic rubbers) or TPEs (Thermoplastic elastomers). In order to avoid unsecured binding affect due to different materials from which the lower and lower layers are fabricated, a middle medium is sandwiched between the upper and lower layers and the entire assembly goes under compression to bond securely relative to one anther.

Preferably, the middle medium is a non-woven fabric having a plurality of fabric holes with a diameter ranging 7-15 nm such that the middle medium is sandwiched between the upper and lower layers once the upper and lower layers are heated up to 160° C.-122° C. and the assembly constituting the upper layer, the middle medium and the lower layer is integrally formed relative to one another after compression process.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

The accompanying drawings are included to provide a further understanding of the invention, and are incorporated in and constitute a part of this specification. The drawings illustrate embodiments of the invention and, together with the description, serve to explain the principles of the invention.

Figure 1:
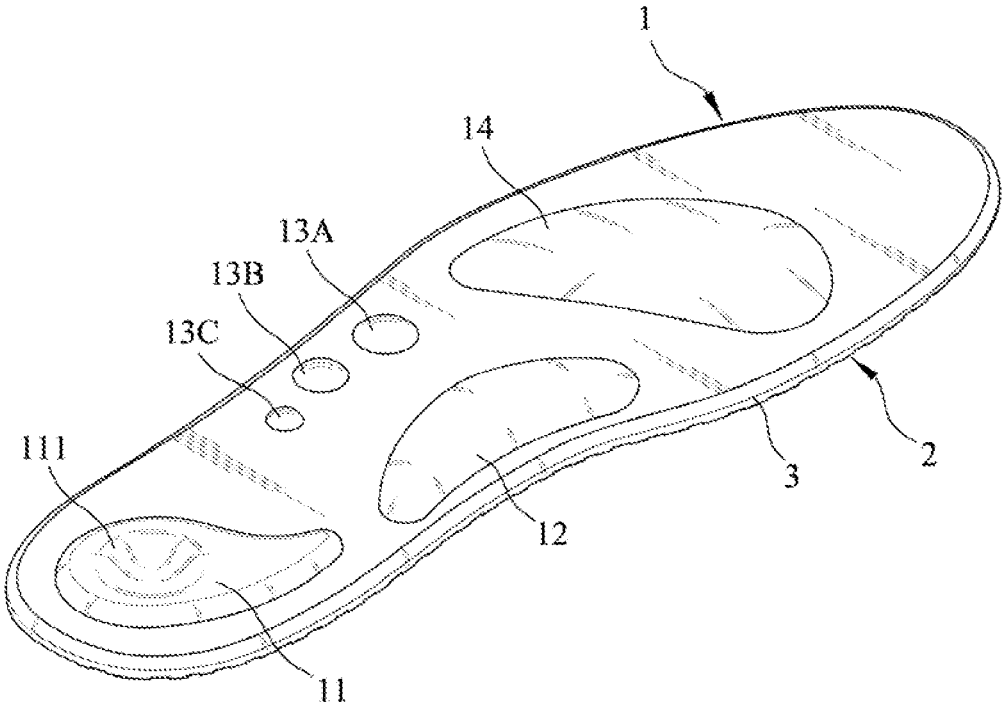
FIG. 1 is a perspective view of a support insole of the present invention for shoes.
Figure 2:
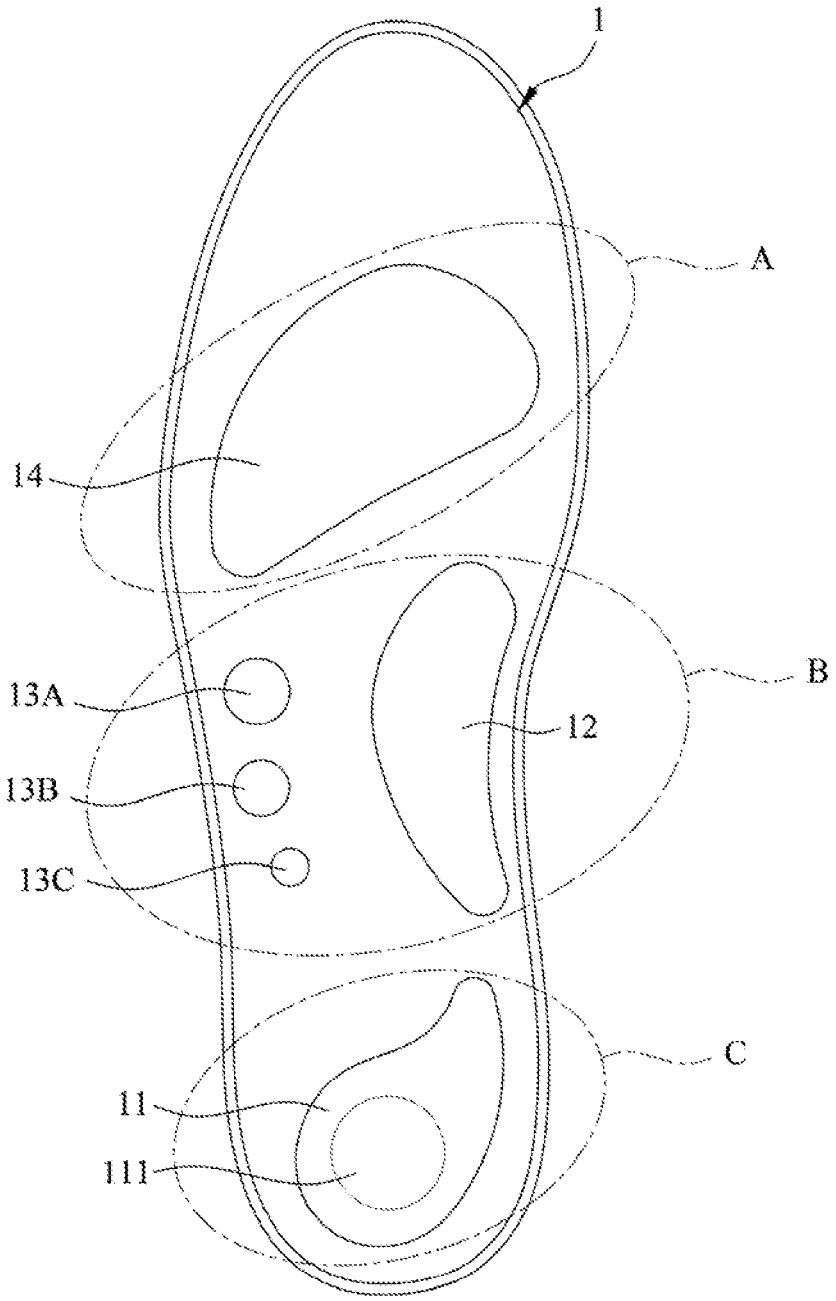
FIG. 2 is a top planar view of the support insole of the present invention shown in FIG. 1.
Figure 3:
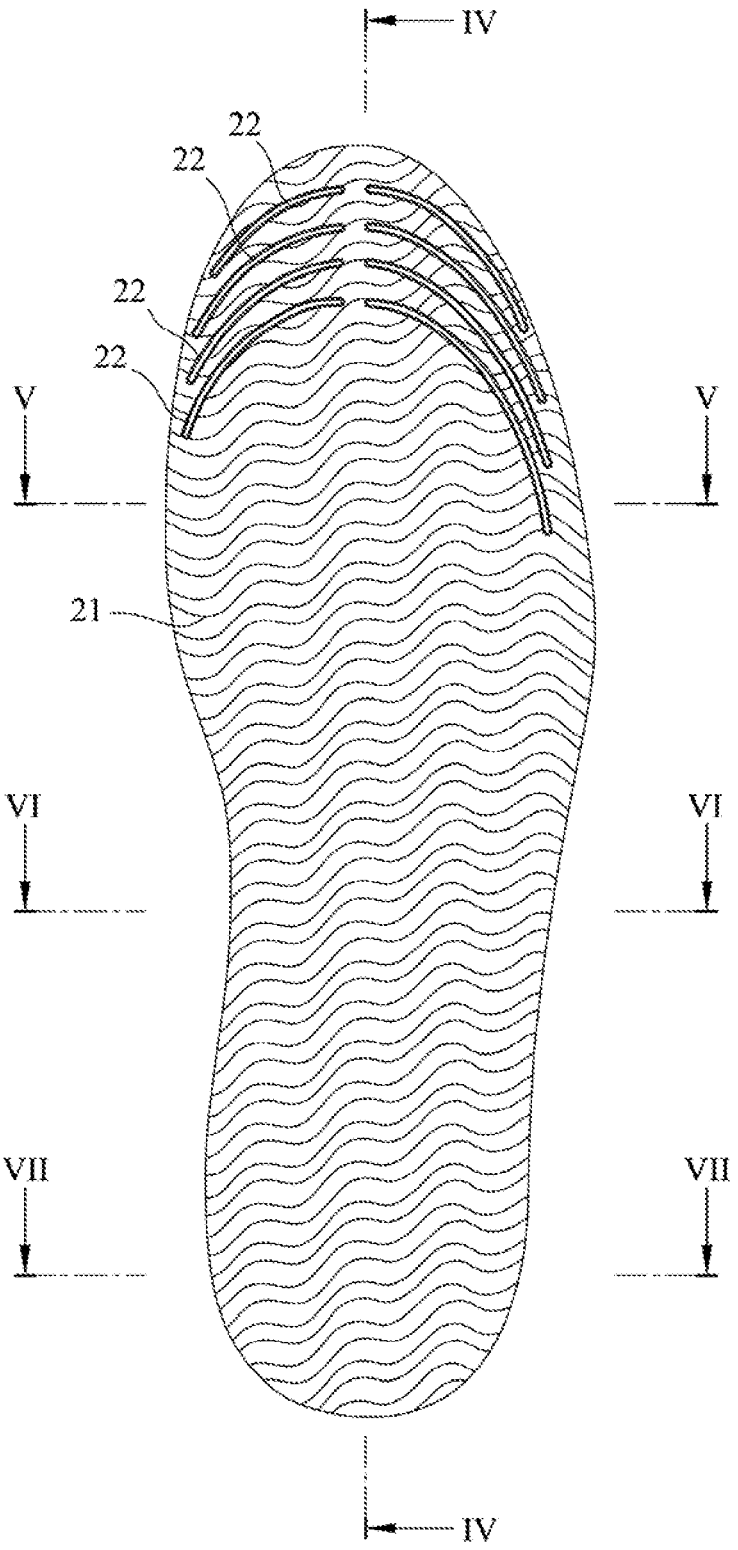
FIG. 3 is a bottom view of the support insole of the present invention shown in FIG. 1.
Figure 4:
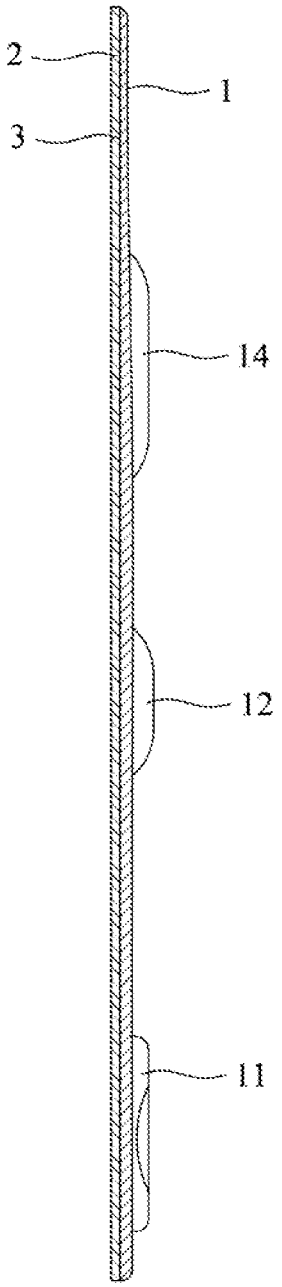
FIG. 4 is a cross-sectional view of the support insole of the present invention taken along lines IV-IV in FIG. 3.
Figure 5:
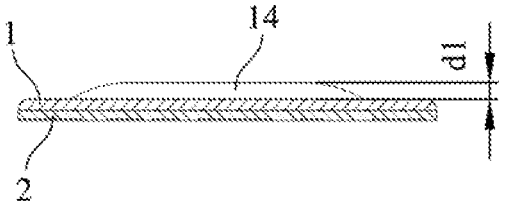
FIG. 5 is a cross-sectional view of the support insole of the present invention taken along lines V-V in FIG. 3.
Figure 6:
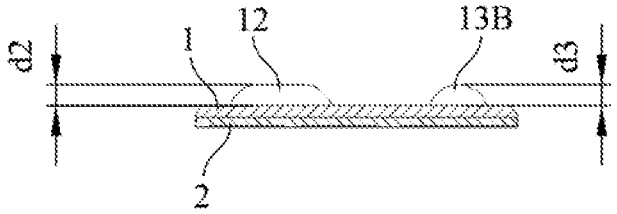
FIG. 6 is a cross-sectional view of the support insole of the present invention taken along lines VI-VI in Fig.
Figure 7:
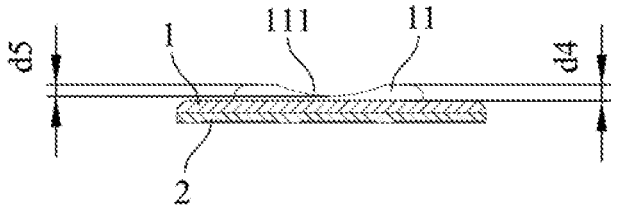
FIG. 7 is a cross-sectional view of the support insole of the present invention taken along lines VII-VII in FIG. 3.

Referring to FIGS. 1 to 7, wherein FIG. 1 is a perspective view of a support insole of the present invention for a shoe; FIG. 2 is a top planar view of the support insole of the present invention shown in FIG. 1; FIG. 3 is a bottom view of the support insole of the present invention shown in FIG. 1; FIG. 4 is a cross-sectional view of the support insole of the present invention taken along lines IV-IV in FIG. 3; FIG. 5 is a cross-sectional view of the support insole of the present invention taken along lines V-V in FIG. 3; FIG. 6 is a cross-sectional view of the support insole of the present invention taken along lines VI-VI in Fig.; and FIG. 7 is a cross-sectional view of the support insole of the present invention taken along lines VII-VII in FIG. 3. It is to note that though only a left support insole is used for better understanding of the present invention, the structure should also include for the right support insole.

Referring to FIGS. 1-3, a support insole of the present invention accordingly includes a flexible upper layer 1, a flexible lower layer 2 and a middle medium 3. The middle medium 2 is sandwiched between the upper and lower layers 1, 2 in order to securely and fixedly bond the upper and lower layers 1, 2 together, which are fabricated from different materials.

Preferably, the flexible upper layer 1 is fabricated from foam materials including EVA (Ethylene-vinyl acetate), Latex and PU (Polyurethane) such that the upper layer 1 is configured as and has a profile fitting an inner bottom side of a shoe, includes a forefoot region A, a midfoot region B and a hindfoot region C, wherein the forefoot region A has a metatarse protrusion 14 that projects upward from an upper surface of the upper layer and that has a height d1, where the greatest elevation d1 is preferably between 3 mm-4 mm (see FIG. 5). In addition, the metatarse protrusion 14 has a profile when viewed from a top planar side, extends inclinedly from a right top to a left bottom and with a width that gradually decreases from the right top toward the left bottom, thereby facilitating in cushioning and supporting the metatarse portion of a foot.

The midfoot region B has opposite inner and outer arch sides, wherein the inner arch side has an inner arch protrusion 12 that projects upwardly from the upper surface of the upper layer to a certain height, wherein the outer arch side has a plurality of outer arch protrusions 13A, 13B, 13C that project upwardly from the upper surface of the upper layer to a certain height. As best shown in FIG. 6, the inner arch protrusion 12 has the greatest elevation d2 between 4.2 mm-4.8 mm with respect to the upper surface of the upper layer 1 while the outer arch protrusions 13A, 13B, 13C have the greatest elevation d3 between 4.2 mm-4.8 mm with respect to the upper surface of the upper layer 1.

In addition, when the support insole of the present invention is viewed from a top side, the inner arch protrusion 12 looks like a non-full moon while each of the outer arch protrusions 13A, 13B, 13C is hemispherical shape. The outer arch protrusions 3A, 13B, 13C extend from a front part to a rear part of the upper layer 1 and include a first outer arch protrusion 13A, a second outer arch protrusion 13B and a third outer arch protrusion 13C, wherein the first outer arch protrusion 13A has a diameter greater than that of the second outer arch protrusion 13B while the second outer arch protrusion 13B has a diameter greater than that of the third outer arch protrusion 13C. Preferably, the inner arch protrusion 12 of the inner arch side has a volume greater than a combined total volume of the first outer arch protrusion 13A, the second outer arch protrusion 13B and the third outer arch protrusion 13C. More preferably, the metatarse protrusion 14 of the forefoot region A has a volume greater than the volume of the inner arch protrusion 12 of the inner arch side. Under this condition, once a person's foot is disposed over the flexible upper insole of the present invention, the inner arch protrusion 12 and the first, second and third outer arch protrusions 13A, 13B, 13C simultaneously provide the best support and cushion effect to the inner and outer arch portions of the foot.

The hindfoot region C of the upper layer 1 has a heel support protrusion 11 that projects upwardly from the upper surface of the upper layer to a certain height and that has a top face with the greatest elevation d4 ranging between 3 mm-4 mm with respect to the upper surface of the upper layer, wherein the top face is dented inwardly so as to form a concave recess 111 with a depth of 2.2 mm-2.7 mm (see FIG. 7) such that once a person's foot is disposed over the flexible upper insole of the present invention, the heel of the wearing foot is stably retained in the concave recess 111, thereby providing comfort support to the heel.

The flexible lower layer 2 is fabricated from materials including TPRs (Thermoplastic rubbers) or TPEs (Thermoplastic elastomers) such that the lower layer 2 is also configured as and has a profile fitting an inner bottom side of a shoe. The middle medium 2 is sandwiched between the upper and lower layers 1, 2 in order to securely and fixedly bond the upper and lower layers 1, 2 together, which are fabricated from different materials. In the preferred embodiment, the middle medium 3 is attached to a bottom surface of the upper layer 1 while the flexible lower layer 2 has an upper surface attached to a bottom surface of the middle medium 3.

Since the lower layer 2 is to contact with the interior of the shoe once the support insole is inserted into a shoe, some three-dimensional patterns 21 are from on the bottom surface of the lower layer 2 such that the three-dimensional pattern 22 contact the interior of the shoe to provide anti-frictions, thereby prevent slippery between the support insole of the present invention with the shoe, which is the primary object of the present invention.

In one embodiment of the present invention, the middle medium 3 is a non-woven fabric having a plurality of fabric holes with a diameter ranging 7-15 nm such that the middle medium 3 is sandwiched between the upper and lower layers 1, 2 (see FIG. 4) once the upper and lower layers are heated up to 160° C.-122° C. and the assembly constituting the upper layer 1, the middle medium 3 and the lower layer 2 is formed relative to one another after compression process such that the materials of the upper and lower layers 1, 2 infiltrate into the fabric holes, thereby forming an integral piece. In other words, the upper surface of the middle medium 3 is integrally formed with a lower surface of the upper layer 1 while the bottom surface of the middle medium 3 is integrally formed with the upper surface of the lower layer 2 due to heating and compression.

Since the dimension of each foot different from one another and in order to fit the configuration of an individual foot, a plurality of cutting lines 22 are provided at different location and extend from a front portion to a rear portion of the lower layer 2, thereby providing different foot profiles such that a user can cut the support insole of the present invention according to the requirement of an individual need.

An important aspect to note is that when the support insole of the present invention is inserted into the interior of a shoe, the metatarse protrusion 14 of the forefoot region A, the inner and outer arch protrusions 12, 13A-13C of the midfoot region B and the hindfoot region C provide a total support and cushioning effect to the foot, thereby preventing occurrence of fatigue to the foot. In addition, due to present of the concave recess 111 in the hindfoot region C such that once a person's foot is disposed over the flexible upper insole of the present invention, the heel of the wearing foot is stably and ergonomically retained in the concave recess 111, thereby providing comfort support to the heel.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A support insole comprising:

a flexible upper layer configured as an inner bottom side of a shoe, including a forefoot region, a midfoot region and a hindfoot region, wherein said forefoot region has a metatarse protrusion that projects upward from an upper surface of said upper layer and that has the greatest elevation of 3 mm-4 mm, said midfoot region has opposite inner and outer arch sides, wherein said inner arch side has an inner arch protrusion that projects upwardly from said upper surface of said upper layer to a certain height and that has the greatest elevation of 4.2 mm-4.8 mm with respect to the upper surface of said upper layer, wherein said outer arch side has a plurality of outer arch protrusions that project upwardly from said upper surface of said upper layer to a certain height and that has the greatest elevation of 4.2 mm-4.8 mm with respect to the upper surface of said upper layer, said hindfoot region having a heel support protrusion that projects upwardly from said upper surface of said upper layer to a certain height and that has a top face with the greatest elevation of 3 mm-4 mm with respect to the upper surface of said upper layer, wherein said top face is dented inwardly so as to form a concave recess with a depth of 2.2 mm-2.7 mm;

a middle medium attached to a bottom surface of said upper layer; and a flexible lower layer having an upper surface attached to a bottom surface of said middle medium.

2. The support insole according to claim 1, wherein each of said outer arch protrusions is hemispherical shape, said outer arch protrusions extending from a front part to a rear part of said upper layer and including a first outer arch protrusion, a second outer arch protrusion and a third outer arch protrusion, wherein said first outer arch protrusion has a diameter greater than that of said second outer arch protrusion while said second outer arch protrusion has a diameter greater than that of said third outer arch protrusion.

3. The support insole according to claim 2, wherein said inner arch protrusion of said inner arch side has a volume greater than a combined total volume of said first outer arch protrusion, said second outer arch protrusion and said third outer arch protrusion.

4. The support insole according to claim 3, wherein said metatarse protrusion of said forefoot region has a volume greater than said volume of said inner arch protrusion of said inner arch side.

5. The support insole according to claim 4, wherein said heel support protrusion of said hindfoot region has a volume greater than said volume of said inner arch protrusion of said inner arch side.

6. The support insole according to claim 5, wherein said flexible upper layer is fabricated from foam materials including EVA (Ethylene-vinyl acetate), Latex, PU (Polyurethane) and while said flexible lower layer 2 is fabricated from materials including TPRs (Thermoplastic rubbers) or TPEs (Thermoplastic elastomers).

7. The support insole according to claim 6, wherein said middle medium is a non-woven fabric having a plurality of fabric holes with a diameter ranging 7-15 nm such that said middle medium is sandwiched between said upper and lower layers once said upper and lower layers are heated up to 160° C.-122° C. and the assembly constituting said upper layer, said middle medium and said lower layer is integrally formed relative to one another after compression process.

* * * * *